US009962715B2

(12) United States Patent
Grønnegaard

(10) Patent No.: US 9,962,715 B2
(45) Date of Patent: May 8, 2018

(54) DECANTER CENTRIFUGE AND A SCREW CONVEYER

(75) Inventor: Erland Grønnegaard, Rodovre (DK)

(73) Assignee: ALFA LAVAL CORPORATE AB, Lund (SE)

( * ) Notice: Subject to any disclaimer, the term of this patent is extended or adjusted under 35 U.S.C. 154(b) by 847 days.

(21) Appl. No.: 13/376,974

(22) PCT Filed: Jun. 11, 2010

(86) PCT No.: PCT/DK2010/050135

§ 371 (c)(1),
(2), (4) Date: Feb. 13, 2012

(87) PCT Pub. No.: WO2010/142299

PCT Pub. Date: Dec. 16, 2010

(65) Prior Publication Data

US 2012/0129677 A1 May 24, 2012

(30) Foreign Application Priority Data

Jun. 12, 2009 (DK) ..... 2009 70028

(51) Int. Cl.
*B04B 1/20* (2006.01)

(52) U.S. Cl.
CPC ..... *B04B 1/20* (2013.01); *B04B 2001/205* (2013.01)

(58) Field of Classification Search
CPC ..... B04B 1/20; B04B 2001/205
(Continued)

(56) References Cited

U.S. PATENT DOCUMENTS 3,731,367 A 5/1973 Laussermair et al.
3,797,737 A 3/1974 Kadotani et al.
(Continued)

FOREIGN PATENT DOCUMENTS

CN 1646229 A 7/2005
DE 1936920 A1 2/1971
(Continued)

OTHER PUBLICATIONS

Office Action for corresponding Chinese Application No. 201080026417.5 dated Dec. 24, 2012.
(Continued)

*Primary Examiner* — Walter D. Griffin
*Assistant Examiner* — Marc C Howell
(74) *Attorney, Agent, or Firm* — Murtha Cullina LLP

(57) ABSTRACT

A decanter centrifuge for separating a supplied material in a light phase and a heavy phase comprising an elongate bowl arranged for rotation about its longitudinal axis, the bowl having a separation chamber with a circumferential wall, a screw conveyor being provided in the separation chamber and being coaxial with the bowl, the screw conveyor comprising a conveyor hub. The conveyor hub comprises a longitudinal tubular steel body part and a helical steel conveyor flight attached to the tubular steel body part. The conveyor hub further comprises an inner longitudinal body extending coaxially relative the longitudinal tubular steel body part. The inner longitudinal body is extending through at least a part of the tubular steel body and is made of a first material, such as carbon fiber reinforced epoxy, whose specific modulus is larger than specific modulus of the steel material of the tubular steel body part.

20 Claims, 3 Drawing Sheets

(58) Field of Classification Search
USPC ..... 494/53
See application file for complete search history.

(56) References Cited

U.S. PATENT DOCUMENTS

| | | | | |
|---|---|---|---|---|
| 3,997,106 | A | 12/1976 | Baram | |
| 4,053,343 | A | 10/1977 | Carter | |
| 4,154,394 | A | 5/1979 | Reed | |
| 4,160,521 | A | 7/1979 | Lindgren | |
| 4,468,269 | A | 8/1984 | Carey | |
| 4,828,541 | A | 5/1989 | Madsen | |
| 5,345,255 | A | 9/1994 | Nguyen et al. | |
| 5,354,255 | A | 10/1994 | Shapiro | |
| 5,370,796 | A | 12/1994 | Grimwood | |
| 5,397,471 | A * | 3/1995 | Rodebush et al. | 210/360.1 |
| 5,403,260 | A * | 4/1995 | Hensley | 494/53 |
| 5,643,168 | A * | 7/1997 | Piramoon | B04B 7/085 494/16 |
| 6,123,656 | A * | 9/2000 | Michelsen | 494/54 |
| 6,508,752 | B1 * | 1/2003 | Hallgren | B04B 1/08 494/51 |
| 2002/0132718 | A1 | 9/2002 | Koch et al. | |
| 2003/0096691 | A1 | 5/2003 | Koch et al. | |
| 2008/0312060 | A1 * | 12/2008 | Hruschka et al. | 494/53 |

FOREIGN PATENT DOCUMENTS

| | | | |
|---|---|---|---|
| DE | 2251373 | A | 4/1973 |
| DE | 2422304 | C2 | 7/1983 |
| DE | 3346289 | A1 | 7/1984 |
| DE | 4128428 | A1 | 3/1993 |
| DE | 19516635 | A1 | 11/1995 |
| DE | 10233697 | A1 | 2/2004 |
| FR | 2660580 | A1 | 10/1991 |
| GB | 372679 | A | 10/1930 |
| GB | 1330386 | | 9/1973 |
| GB | 2063209 | A | 6/1981 |
| JP | 09150933 | A | 6/1997 |
| KR | 1020060073803 | A | 6/2006 |
| KR | 1020080012559 | A | 2/2008 |
| RU | 2346752 | C1 | 2/2009 |
| WO | 8809216 | | 12/1988 |
| WO | 9109680 | | 7/1991 |
| WO | 9614935 | | 5/1996 |
| WO | 03076078 | | 9/2003 |
| WO | 2003082474 | A2 | 10/2003 |

OTHER PUBLICATIONS

Decision to Grant from corresponding Russian Patent Application No. 2012100777105, dated Feb. 1, 2013.
Notification of Reexamination for corresponding CN Application No. 2010080026417.5, dated Mar. 26, 2015, pp. 1-6.
Decision of Rejection for corresponding CN Application No. 2010080026417.5, dated Jan. 6, 2014, pp. 1-9.
Second Office Action for corresponding CN Application No. 2010080026417.5, dated Jul. 30, 2013, pp. 1-10.
KIPO's Notice of Preliminary Rejection for Korean Application No. 10-2012-7000791, pp. 1-5.

* cited by examiner

DECANTER CENTRIFUGE AND A SCREW CONVEYER

BACKGROUND OF THE INVENTION

A decanter centrifuge of this kind is known from U.S. Pat. No. 5,354,255, which discloses a decanter centrifuge with a hollow bowl surrounding a rotating screw conveyor having a substantially cylindrical conveyor hub, which carries a screw comprising one or more flights. In order to resist the harsh environment encountered in many applications, the body as well as the screw of the screw conveyor of the type disclosed in U.S. Pat. No. 5,354,255 are typically manufactured in a resistant material such as steel.

A series of longitudinally extending and radially projecting supporting ribs is attached to the conveyor hub. Their cross-sectional area increases with the distance from the hub. Their purpose is to render possible reduction of the diameter of the conveyor hub, without detrimental impact on the capability of withstanding high speed operating conditions of thus formed structural unit comprising said hub and ribs. Such reduction of the hub diameter provides for reducing the diameter of the inner surface of a pond of supplied material in the separation chamber, which results in a reduced power demand of the decanter centrifuge.

However, the complex centrifuge design, as disclosed in U.S. Pat. No. 5,354,255, comprising radially projecting ribs renders its manufacturing rather difficult. In addition, ribs take up space in the bowl, thus reducing its useful volume.

WO-A-96/14935 discloses a very special decanter centrifuge mainly made of polyurethane. Thus WO-A-96/14935 discloses a decanter centrifuge having a drum and a conveyor with a hub and helical flights wherein the helical flights are made of polyurethane and are resting against the inner surface of the drum, which will stabilise the conveyor and provides a scraping effect on sedimented material. The material of the flights provides for a density of the flights in the same order as the density of the liquid phase of a material to be treated in the centrifuge, thus increasing the first critical vibration frequency of the conveyor, which provides for increasing the length or the rotational speed of the centrifuge thereby increasing its separation capacity. The hub of the conveyor is made of the same material as the flights i.e. the elastomeric material: polyurethane, whereby the conveyor is castable in a simple mould. To provide stiffness to the conveyor a pipe of carbon fibre reinforced resin is cast-in reaching from one end of the conveyor to the other between the bearings supporting the conveyor.

SUMMARY OF THE INVENTION

The present invention is directed in one aspect to providing a decanter centrifuge, which provides for a reduced diameter of the conveyor hub, said conveyor hub being capable of withstanding high speed operating conditions, while avoiding the above mentioned drawbacks of the prior art.

Accordingly, in one aspect there is a provided a decanter centrifuge for separating a supplied material in a light phase and a heavy phase comprising: an elongate bowl arranged for rotation about its longitudinal axis, said bowl having a separation chamber with a circumferential wall, a screw conveyor being provided in the separation chamber and being substantially coaxial with the bowl, said screw conveyor comprising a conveyor hub, said conveyor hub comprising a longitudinal tubular steel body part, and a helical steel conveyor flight attached to said longitudinal tubular steel body part, wherein said conveyor hub further comprises an inner longitudinal body extending coaxially relative said longitudinal tubular steel body part, said inner longitudinal body extending through at least a part of the longitudinal tubular steel body part and being made of a first material whose specific modulus is larger than specific modulus of the steel material of the longitudinal tubular steel body part.

By providing said inner longitudinal body in a different material, thus effectively separating the conveyor hub in two substantially coaxially extending, cylindrically shaped components, it may be achieved that the diameter of the conveyor hub is reduced. To that purpose, the above-mentioned inner longitudinal body is made of material whose specific modulus is larger than specific modulus of the steel material of the tubular steel body part. The specific modulus or stiffness-to-weight ratio is defined as the ratio of elastic modulus and mass density of a material. Such a material is at the same time rigid and lightweight. Consequently, relevant material properties may be improved. Thus, the wall thickness of the original tubular steel body part may be reduced or so-to-speak replaced by said inner longitudinal body reducing the overall diameter of the hub. Such a conveyor hub and, inferentially, decanter centrifuge are capable of withstanding high speed operating conditions.

In an embodiment, play is provided between the helical flight and the circumferential wall of the bowl. In this way, it may be ensured that contact between the flights and the circumferential wall of the bowl and consequent wear on the flights as well as the circumferential wall of the bowl is avoided.

In a further embodiment, an adhesive layer may be applied between at least a portion of an inner surface of the longitudinal tubular steel body part and an outer surface of the inner longitudinal body. In this way, said body part and said inner body are fixedly engaged to each other.

Said first material may be a fibre reinforced polymer. Fibre reinforced polymers are composite materials made of a polymer matrix reinforced with fibres.

Said polymer may be epoxy. Epoxy is a thermosetting polymer that cures when mixed with a hardener. By using a rigid and lightweight material such as epoxy, an improved decanter centrifuge may be obtained.

Said fibres may comprise carbon fibres. These are known to have a high strength to weight ratio. By reinforcing epoxy with carbon fibres, an additional strengthening of the polymer may be achieved.

In an embodiment, the angle between substantially longitudinally running fibre strands of said fibre reinforced polymer and a longitudinal axis is preferably below 20°, more preferred below 15° and most preferred below 10°. In this way, an increased structural strength of the inner longitudinal body may be achieved. As an advantage, the risk of crack formation in the body may be greatly reduced.

Preferably at least one winding of fibre strands is arranged circumferentially relative said longitudinal axis for every 5-20 substantially longitudinal windings.

In an embodiment, said inner longitudinal body is tubular and may have a wall thickness that is at least equal to wall thickness of said longitudinal tubular steel body part.

In a different embodiment, said inner longitudinal body may, over at least a part of its length, radially extend to the centre of the conveyor hub. In this way, given the superior properties of the first material, it may be achieved that the weight and the diameter of the conveyor hub may be significantly reduced, while its other properties at any rate are maintained.

Other objectives, features and advantages of the present invention will appear from the following detailed disclosure, from the attached claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

The invention also relates to a screw conveyor as described above.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION

Figure 1:
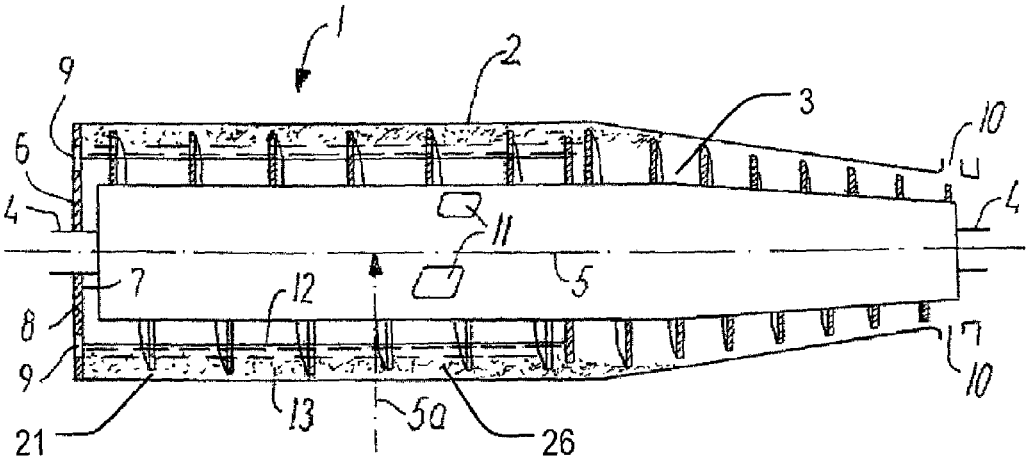
FIG. 1 shows schematically a decanter centrifuge 1.

The decanter centrifuge 1 shown in FIG. 1 comprises a bowl 2 and a screw conveyor 3 which are mounted on a shaft 4 such that they in use can be brought to rotate around an axis 5 of rotation, the axis 5 of rotation extending in a longitudinal direction of the bowl 2. Further, the decanter centrifuge 1 has a radial direction 5*a* extending perpendicularly to the longitudinal direction.

For the sake of simplicity directions "up" and "down" are used herein as referring to a radial direction towards the axis 5 of rotation and away from the axis 5 of rotation, respectively.

The bowl 2 comprises a base plate 6 provided at one longitudinal end of the bowl 2, which base plate 6 has an internal side 7 and an external side 8. The base plate 6 is provided with a number of liquid phase outlet openings 9. Furthermore the bowl 2 is at an end opposite to the base plate 6 provided with solid phase discharge openings 10.

In addition, the screw conveyor 3 comprises inlet openings 11 for supplying a material e.g. a slurry to the decanter centrifuge 1, the slurry comprising a light or liquid phase 12 and a heavy or solid phase 13. During rotation of the decanter centrifuge 1 as previously described, separation of the liquid 12 and solid 13 phases is obtained in a separation chamber 26 delimited by a circumferential wall of the bowl 2. The liquid phase 12 is discharged through the liquid phase outlet openings 9 in the base plate 6, while the screw conveyor 3 transports the solid phase 13 towards the solid phase discharge openings 10 through which the solid phase 13 eventually is discharged. As it may be seen, play 21, which is typically 1-2 mm, is provided between the screw conveyor 3 and the circumferential wall of the bowl 2. The play 21 ensures that contact between the flights and the circumferential wall of the bowl 2 is avoided, thus preventing wear on the flights as well as on the circumferential wall of the bowl 2.

Figure 2A:
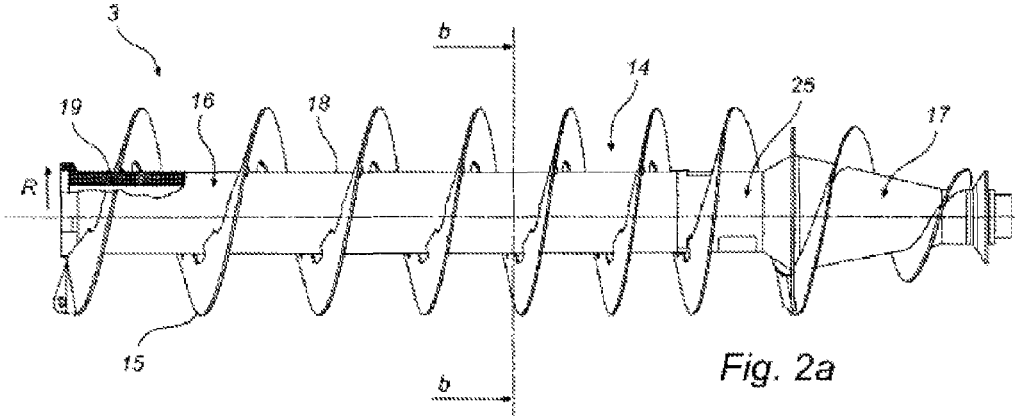
FIG. 2*a* is a front view of a conveyor hub according to a first embodiment of the present invention.
Figure 2B:
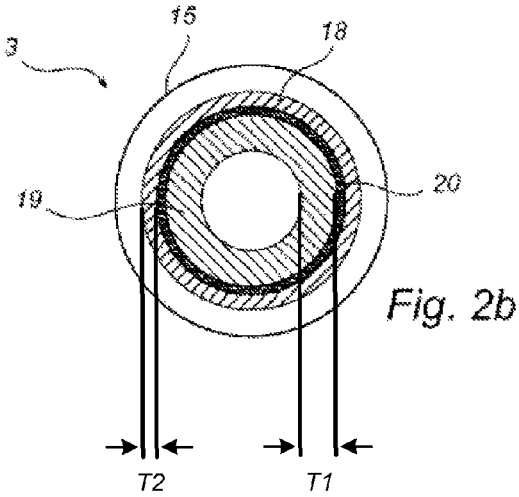
FIG. 2*b* is a cross-sectional view of the conveyor hub along the line b-b of FIG. 2*a;*

FIG. 2*a* is a front view of a screw conveyor 3 in another embodiment while FIG. 2*b* is a cross-sectional view of said screw conveyor 3 along the line b-b of FIG. 2*a*. The screw conveyor 3 comprises the conveyor hub 14 and a helical conveyor flight 15 attached to its outer surface, both provided in steel material. The conveyor hub 14 comprises a cylindrical section 16 having an outer radius (R), a substantially frusto-conical section 17 and a feed inlet section 25 positioned between the cylindrical section 16 and the frusto-conical section 17. A longitudinal tubular steel body part 18 constitutes the outermost portion of said cylindrical section 16. By providing the outermost portion of said cylindrical section 16 in steel material it is ensured that the conveyor hub 14 may withstand the potentially damaging effect of the supplied material. The feed inlet section 25 is provided with inlet openings 11 for supplying the slurry into the interior of the bowl 2, i.e. the separation chamber 26.

Figure 2C:
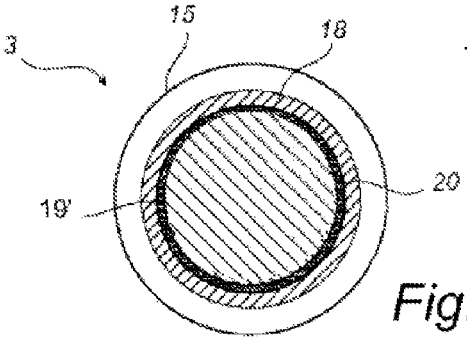
FIG. 2*c* is a cross-sectional view corresponding to FIG. 2*b*, but showing a variant of the conveyor hub.
Figure 3:
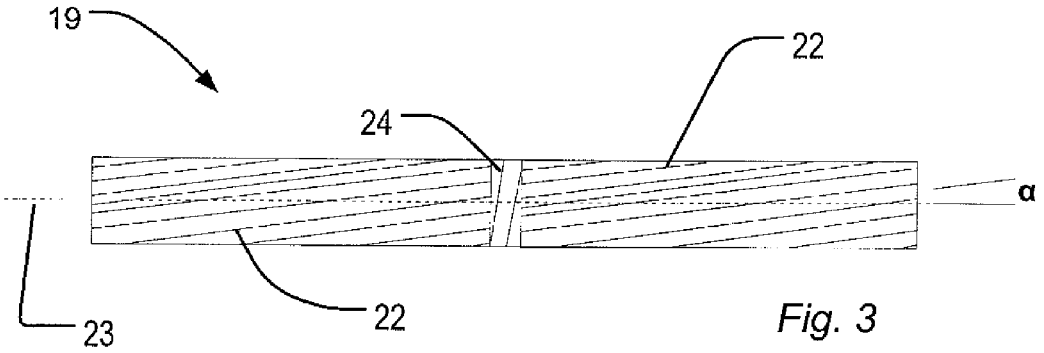
FIG. 3 shows an inner longitudinal body with fibre strands according to an embodiment of the present invention.

The cylindrical section 16 further comprises an inner longitudinal body 19 that may be tubular and that extends coaxially relative said longitudinal tubular steel body part 18 and through the cavity defined by the longitudinal tubular steel body part 18. In a variant embodiment, an inner longitudinal body 19' may, over at least a part of its length, radially extend to the centre of the conveyor hub 14, as shown in FIG. 2*c*. The inner longitudinal body 19 is made of a material whose specific modulus is larger than specific modulus of the steel material of the longitudinal tubular steel body part 18. The inner longitudinal body 19 and the longitudinal tubular body part 18 are made from a suitable material, such as but not limited to, steel. The specific modulus or stiffness-to-weight ratio is defined as the ratio of elastic modulus and mass density of a material. The material of the inner longitudinal body 19 is, thus, rigid and lightweight. In the preferred embodiment, an epoxy matrix reinforced with carbon fibres, more thoroughly described in conjunction with FIG. 3, is used. A plurality of other materials may be envisaged, provided that their specific modulus is larger than specific modulus of the steel material of the longitudinal tubular steel body part 18. Other polymers as well as non-polymer materials, are equally conceivable. By way of example, carbon fibres may be substituted with kevlar or glass fibres. By combining the longitudinal tubular steel body part 18 and the therein enclosed, inner longitudinal body 19 in rigid and lightweight material, it is achieved that the conveyor hub 14 and, inferentially, decanter centrifuge 1 are capable of withstanding high speed operating conditions while the diameter of the conveyor hub 14 is reduced. The longitudinal tubular steel body part 18 may be constructed with a decreased wall thickness compared to conventional decanter centrifuges. In some embodiments, inner longitudinal body 19 has a greater thickness (T1) than the thickness of longitudinal tubular steel body part 18 (T2). However the wall thickness should be sufficient to provide the necessary strength for carrying the helical conveyor flight 15, which is usually welded onto the hub 14.

As it may be seen in FIG. 2*b*, an adhesive layer 20 is applied at the interface between the longitudinal tubular steel body part 18 and the inner longitudinal body 19. By applying said adhesive layer 20, said longitudinal tubular steel body part 18 and said inner longitudinal body 19 are fixedly engaged to each other. A suitable adhesive is, for instance, epoxy.

FIG. 3 shows an inner longitudinal body 19 with fibre strands 22 according to an embodiment of the present invention. The fibre strands 22 are wound into a tube and worked into the polymer matrix in a manner well known to the person skilled in the art. In order to achieve a strong and rigid material, carbon fibres are used. In some embodiments, inner longitudinal body 19 includes a first section having at least one fiber, e.g., at least one of fibre strands 22, along a longitudinal axis 23 at an angle ($\alpha$) relative to the longitudinal axis of the inner longitudinal body, and a second section adjoining the first section, the second section having at least one second fiber, e.g., at least one of fibre strands 24, arranged circumferentially to the longitudinal axis. Said angle ($\alpha$) is preferably inferior to 20° corresponding to a single winding extending from one end to the other of the tube. This provides for maximum bending strength of the tube. In addition, the at least one winding or layer of fibre strands 24 is arranged substantially circumferentially relative said longitudinal axis for every 5-20 substantially longitudinal windings 22. In this way, an increased structural strength of the inner longitudinal body 19 may be achieved. As an advantage, the risk of crack formation in the inner longitudinal body 19 may be greatly reduced.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A decanter centrifuge for separating a supplied material in a light phase and a heavy phase, comprising:

an elongate bowl arranged for rotation about its longitudinal axis, said bowl having a separation chamber with a circumferential wall, a screw conveyor being provided in the separation chamber and being substantially coaxial with the bowl, said screw conveyor comprising a conveyor hub, said conveyor hub comprising a longitudinal tubular steel body part, and a helical steel conveyor flight attached to said longitudinal tubular steel body part, said conveyor hub further comprising an inner longitudinal body extending substantially coaxially relative to said longitudinal tubular steel body part, said inner longitudinal body extending through at least a part of the longitudinal tubular steel body part and being made of a first material whose specific modulus is larger than a specific modulus of the steel material of the longitudinal tubular steel body part;

wherein said inner longitudinal body comprises a first section having at least one fiber along a longitudinal axis of said inner longitudinal body at an angle relative to said longitudinal axis, and a second section adjoining the first section, the second section having at least one second fiber arranged circumferentially to the longitudinal axis.

2. A decanter centrifuge according to claim 1, wherein an adhesive layer is applied between at least a portion of an inner surface of the longitudinal tubular steel body part and an outer surface of the inner longitudinal body.

3. A decanter centrifuge according to claim 1, wherein said first material is a fiber reinforced polymer.

4. A decanter centrifuge according to claim 3, wherein said polymer is epoxy.

5. A decanter centrifuge according to claim 3, wherein said fibers comprise carbon fibers.

6. A decanter centrifuge according to claim 1, wherein said at least one fiber of said first section runs at an angle below 20° to said longitudinal axis of the inner longitudinal body to maximize bending strength.

7. A decanter centrifuge according to claim 1, wherein said at least one fiber of said first section runs at an angle below 15° to said longitudinal axis of the inner longitudinal body to maximize bending strength.

8. A decanter centrifuge according to claim 1, wherein said at least one fiber of said first section runs at an angle below 10° to said longitudinal axis of the inner longitudinal body to maximize bending strength.

9. A decanter centrifuge according to claim 1, wherein at least one second fiber is arranged circumferentially relative to said longitudinal axis for every 5-20 substantially longitudinal windings.

10. A decanter centrifuge according to claim 1, wherein said inner longitudinal body is tubular and has a wall thickness that is at least equal to a wall thickness of said longitudinal tubular steel body part.

11. A decanter centrifuge according to claim 1, wherein said inner longitudinal body, over at least a part of its length, radially extends to a center of the conveyor hub.

12. A decanter centrifuge for separating a supplied material in a light phase and a heavy phase, comprising:

an elongate bowl arranged for rotation about its longitudinal axis, said bowl having a separation chamber with a circumferential wall, a screw conveyor being provided in the separation chamber and being substantially coaxial with the bowl, said screw conveyor comprising a conveyor hub, said conveyor hub comprising a longitudinal tubular steel body part, and a helical steel conveyor flight attached to said longitudinal tubular steel body part and spaced apart from an inner circumferential wall of the bowl to prevent contact between said helical steel conveyor flight and said inner circumferential wall, said conveyor hub further comprising an inner longitudinal body extending substantially coaxially relative to said longitudinal tubular steel body part, said inner longitudinal body extending through at least a part of the longitudinal tubular steel body part and being made of a first material whose specific modulus is larger than a specific modulus of the steel material of the longitudinal tubular steel body part;

wherein said inner longitudinal body comprises a first section having at least one first carbon fiber running at an angle below 20° to a longitudinal axis of the inner longitudinal body to maximize bending strength and a second section adjoining the first section, said second section having at least one second carbon fiber arranged circumferentially to the longitudinal axis.

13. A decanter centrifuge according to claim 12, wherein an adhesive layer is applied between at least a portion of an inner surface of the longitudinal tubular steel body part and an outer surface of the inner longitudinal body.

14. A decanter centrifuge according to claim 12, wherein said first material is a fiber reinforced polymer.

15. A decanter centrifuge according to claim 14, wherein said polymer is epoxy.

16. A decanter centrifuge according to claim 12, wherein said at least one fiber of said first section runs at an angle below 15° to said longitudinal axis of the inner longitudinal body to maximize bending strength.

17. A decanter centrifuge according to claim 12, wherein said at least one fiber of said first section runs at an angle below 10° to said longitudinal axis of the inner longitudinal body to maximize bending strength.

18. A decanter centrifuge according to claim 12, wherein at least one second fiber is arranged circumferentially relative to said longitudinal axis for every 5-20 substantially longitudinal windings.

19. A decanter centrifuge according to claim 12, wherein said inner longitudinal body is tubular and has a wall thickness that is at least equal to a wall thickness of said longitudinal tubular steel body part.

20. A decanter centrifuge according to claim 12, wherein said inner longitudinal body, over at least a part of its length, radially extends to a center of the conveyor hub.

* * * * *